United States Patent [19]

Littleton

[11] Patent Number: 4,682,767

[45] Date of Patent: Jul. 28, 1987

[54] APPARATUS FOR FOLDING AND DELIVERING SHEET MATERIAL

[76] Inventor: Francis J. Littleton, 182 McNair Rd., Buffalo, N.Y. 14221

[21] Appl. No.: 768,897

[22] Filed: Aug. 23, 1985

[51] Int. Cl.[4] ..... B41C 1/00

[52] U.S. Cl. ..... 270/45; 198/462; 271/202

[58] Field of Search ..... 270/45–47, 270/58; 198/423–424, 431, 434, 456, 460, 461–462; 271/7, 121, 182, 198, 202, 203, 216

[56] References Cited

U.S. PATENT DOCUMENTS

| | | | |
|---|---|---|---|
| 486,558 | 7/1886 | Crowell . | |
| 1,071,755 | 9/1913 | King . | |
| 1,128,537 | 2/1915 | Sigafoos . | |
| 2,464,823 | 3/1949 | Malott, Jr. . | |
| 2,514,737 | 7/1950 | Anderson . | |
| 2,782,898 | 2/1957 | Novick | 198/462 |
| 2,789,815 | 4/1957 | Nash, Jr. et al. | 270/45 |
| 2,821,386 | 1/1958 | Petre . | |
| 2,912,238 | 7/1956 | Karnahl . | |
| 3,132,737 | 5/1964 | Moon et al. . | |
| 3,160,410 | 6/1962 | Everson . | |
| 3,464,537 | 9/1969 | Thull | 198/462 |
| 3,507,489 | 9/1967 | Wilshin et al. . | |
| 3,650,527 | 3/1972 | Helm . | |
| 3,749,394 | 7/1973 | McCain et al. . | |
| 3,752,043 | 8/1973 | Rapparlie et al. | 271/202 |
| 3,859,898 | 1/1975 | Besserdich et al. . | |
| 3,911,800 | 10/1975 | Feldkamper | 198/462 |
| 3,994,221 | 11/1976 | Littleton . | |
| 3,995,850 | 12/1976 | Hertrich et al. . | |
| 4,040,617 | 8/1977 | Walkington . | |
| 4,053,150 | 10/1977 | Lane | 493/417 |
| 4,214,744 | 7/1980 | Evans | 271/202 |
| 4,364,552 | 12/1982 | Besemann . | |
| 4,376,531 | 3/1983 | Brevnig | 271/202 |
| 4,471,955 | 9/1984 | Bradley et al. | 270/58 |
| 4,516,759 | 5/1985 | Kobler | 271/202 |
| 4,548,404 | 10/1985 | Brandt et al. | 198/462 |

FOREIGN PATENT DOCUMENTS

| | | | |
|---|---|---|---|
| 261461 | 6/1913 | Fed. Rep. of Germany | 270/45 |
| 2141340 | 2/1973 | Fed. Rep. of Germany | 271/202 |
| 1158844 | 7/1969 | United Kingdom . | |
| 2025372 | 1/1980 | United Kingdom | 271/202 |

*Primary Examiner*—E. H. Eickholt

*Attorney, Agent, or Firm*—Neuman, Williams, Anderson & Olson

[57] ABSTRACT

An apparatus for folding and shingling sheets in which the sheets, upon exiting the printing operation, enter a controlled slow-down section between a series of high-speed, face-to-face belts. The sheets exit these belts and are decelerated by the action of a snubber means trapping the sheets against a series of slower-speed belts and underlying deck plate. Having been slowed down, the sheets abut a stop member wherein a chopper blade impacts the centerline of the sheet thereby driving the sheet through a slot in the deck plate and into the grasp of a pair of biased, impinging nip rollers. The nip rollers crease the fold created by the chopper blade and accelerate the sheets into a second series of high-speed, face-to-face belts. These belts deliver the folded sheets to a second slow-down section wherein a second snubber means decelerates the sheets by trapping them against a slower-speed belt. The snubber means, in conjunction with the speed of the delivered sheets, causes each sheet to partially overlap the previous sheet thereby shingling the sheets for delivery to a subsequent counting and stacking operation.

5 Claims, 4 Drawing Figures

APPARATUS FOR FOLDING AND DELIVERING SHEET MATERIAL

The present invention relates to folding and delivery equipment for use in a web press printing operation. In this type of printing operation, successive impressions are made on a continuous web of paper product, and the printed web is then processed, typically, by passing the web through an oven to dry the web, a cooling system such as chill rollers to cool the web leaving the oven, a cutting and folding section, and a delivery section. One way known in the art to form a longitudinal fold in a web is to pass the web over the nose of a triangular shaped former board, whereby the web, when its edges are pulled downward across the former board, will form a continuous fold in the direction of the web's travel downstream of the nose of the former board. This once folded web may then be received by a conventional cutting and folding system comprising a number of rotating cylinders. The first cylinder to receive the web holds the web fast by means of a line of pins arranged across the length of the cylinder; the pins pierce the web and carry it around this pin cylinder as the cylinder is rotated. The captured web is cut at this point by a cutter, typically a rotating knife cylinder, in which the knife blade of the knife cylinder beds against the first cylinder, thereby, cutting an individual sheet from the web product carried by the first cylinder. A tucker blade within the pin cylinder pushes outward across the length of the pin cylinder, pushing the central portion of the cut web portion or sheet away from the surface of the pin cylinder. Another cylinder, called a jaw cylinder, pulls the sheet from the pin cylinder at the raised tucker blade by means of a jaw-forming gripping plate, thus folding the sheet again, but in a transverse direction.

The folded sheet may need to be folded again. This further folding operation is conventionally achieved in a chopper folder. The output of the above-described folding operation is a serial stream of folded sheets that are traveling at the speed of the web and are separated by a gap about equal to the length of the sheet. The length of the gap is due to the transverse fold previously accomplished. The folded edge of the sheet is leading. A conventional chopper folder, however, requires that the sheet stream be traveling only at about 1100 feet per minute or less. This is considerably less than the lineal speed of many presses, which may operate at 1800 feet per minute or faster, and so the conventional chopper folder has been a speed limitation on the printing operation. This limitation in speed is necessary due to the damage sustained by individual sheets as they impact a fixed stop plate prior to folding.

The conventional chopper folder consists generally of three sections—a slow down section, a chopping section, and a delivery section. An incoming sheet is fed into the slowdown section between opposed, upper and lower sets of conveyor belts and is stopped by impacting a stationary stop plate, although the sheets may be slowed somewhat by first passing the sheets under overhanging brushes. After being stopped, the sheets are folded longitudinally by a reciprocating chopper blade. The chopper blade drops from above the sheet, traveling through the plane of the sheet and a longitudinal slot in the deck plate supporting the sheet. After a chopping movement, the chopper blade returns to the initial position, ready for the next sheet.

The folded sheet, pushed through the deck plate by the chopper blade and folded thereby, is immediately received by a system of biased nip rollers that press the sheet to ensure a complete fold. From the nip rollers, the sheet is fed to a fan or paddle wheel collector which receives the sheets in successive tines as the collector rotates, and the collector deposits the sheets in a shingled format on a delivery conveyor for delivery to a stacker or other processing station.

The conventional folding systems as just described have various drawbacks. The pin and gripper folding device relies on a complicated cam driven system that is more subject to mechanical failure. This device also produces an unavoidable percentage of waste because the edges of the sheets that have been pierced by the pins and the edges that have been cut by a serrated knife blade must be trimmed off. Also, the systems described above are slow in comparison to the potential operating speed of the printing press. In the chopper folder, the incoming sheets cannot be traveling faster than about 1100 feet per minute or else the sheets will be damaged when they hit the stationary stop plate, or, the sheets may set and fold out of square. In most conventional chopper folders, the chopper blade travels with a simple oscillatory motion and is moving quite fast when it first hits the sheet to be folded. At impact, the sheet is pushed ahead of the position of the blade. This is because the chopper blade reaches its maximum speed prior to impacting the sheet and is decelerating during impact. Thus, all of the energy at impact is instantaneously absorbed by the sheet and results in a whiplash of the outer edges of the sheets as they are whipped through the slot inbetween the deck plates at high speed, following the movement of the chopper blade. In the delivery section of the chopper folder, the leading edges of sheets may be buckled as they are fed into the collector. Also, since the collector is operated by the weight and momentum of the incoming sheets, its speed of operation is limited and the delivery is uncontrolled. This problem is aggravated with lightweight sheets, which may cause jams at high operating speeds.

The present invention avoids the problems associated with conventional chopper folders by providing controlled slowdown, chopping, and delivery sections. Thus, it is an objective of the present invention to provide a folder wherein the incoming sheets are slowed down in a controlled manner and without damaging the lead edge of the sheet. It is a further object of this invention to provide a folder in which the motion of the chopper blade is controlled so as to minimize the possibility of damage to the sheets during operation. It is another object of this invention to provide a delivery system that slows and shingles the sheets in a controlled manner without damage to the sheets. It is another object of this invention to provide a folder in which the sheets are controlled at every stage of the folding operation in order to ensure proper timing and avoid jam-ups caused by uncontrolled sheet movement. It is still another object of this invention to provide a high-speed folder that is simple and practical in construction, and which will operate with any weight of sheet.

According to one aspect of the invention, an initial slowdown section includes a supporting conveyor belt operating at a speed much slower than the incoming sheets, and a pair of rotating snubber wheels that are timed with the arrival of the incoming sheets so as to press the tail of each sheet against the slow speed supporting conveyor belt. After being slowed in this manner without damage, the sheet can be stopped by a stationary stop plate without damage to the leading edge of the sheet.

In another aspect of the invention, the chopper blade operates under cam control so that the motion of the blade can be entirely predetermined. In particular, the blade is controlled to have as short a throw as possible, and contacts the sheet while still accelerating. The blade maintains contact with the sheet and smoothly increases speed thereby dispersing the energy of impact over a longer period of time and reducing the affects of sheet edge whiplash. The blade then decelerates and the sheet continues to travel toward receiving rollers, which crease the sheet and convey the sheet to the delivery section.

Another aspect of the invention is a delivery section that operates in similar fashion to the slowdown section, but which is adapted to operate for any weight of sheet. This section also includes at least one rotating snubber wheel and a low-speed conveyor belt that supports the sheets in the delivery section. The sheets are fed to the delivery section at high speed by opposed high-speed conveyor belts. The lower, high-speed conveyor belt ends short of the delivery section. A low-speed conveyor belt begins just downstream of the end of the lower, high-speed conveyor belt and is dropped relative to the plane of the latter. Whereas the initial slow-down section operates to slow down incoming sheets and decrease the gap between the sheets, the delivery section utilizes the rotating snubbers to trap the tails of successive sheets against the dropped, underlying low-speed belts thus slowing the sheets down and placing the sheets in shingled format. To account for different weights of sheet, a roller defining the return of the lower, high-speed belts is adjustable in the direction of sheet travel, allowing for adjustment to prevent jam-ups of, particularly, lightweight sheets.

BRIEF DESCRIPTION OF THE DRAWINGS

For a more complete understanding of this invention, reference should now be made to the embodiment illustrated in greater detail in the accompanying drawings and described below by way of examples of the invention.

In The Drawings

DETAILED DESCRIPTION

Figure 1:
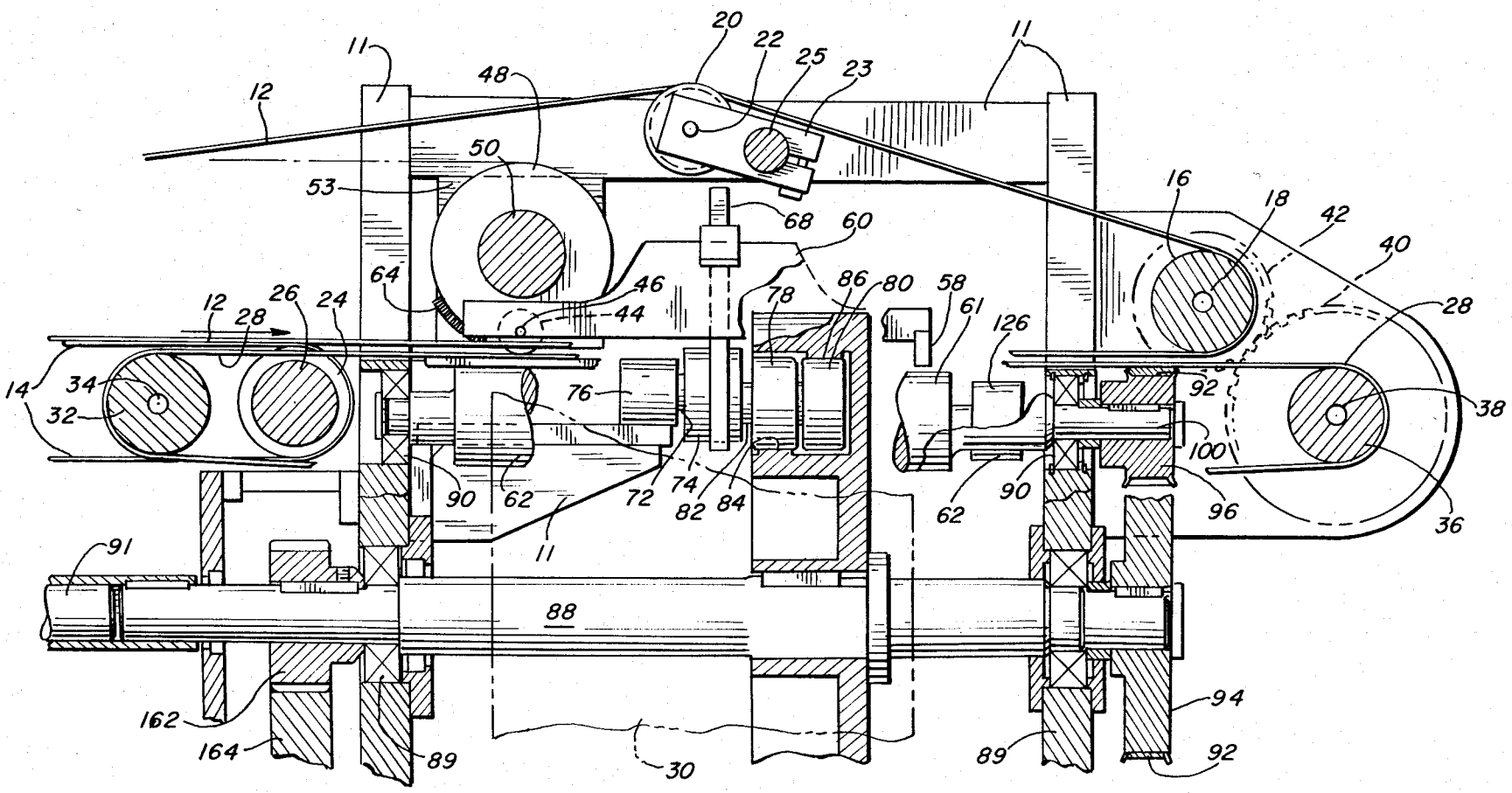
FIG. 1 is a side view of the conveyor system and first snubber means in the initial slow-down section of the preferred embodiment.

The relationship and workings of the various elements of this invention will better be understood by the following detailed description. However, the embodiment of the invention described below is by way of example only and the invention is not limited to this embodiment. Furthermore, one should understand that the drawings are not to scale and that the embodiments are illustrated by graphic symbols and fragmentary views. In certain instances, details may have been omitted which are not necessary for an understanding of the present invention such as conventional details of fabrication and assembly.

Generally, the device of this invention folds and shingles sheets of printed material and is intended to be integrated into a full service printing system. The device will follow the actual printing and cutting operation and will precede a stacking and counting operation. This invention will supply the stacking and counting operation with shingled sheets of printed material and may be used in conjunction with other folding devices to impart multiple folds to a sheet.

Sheets enter the device at high speed, approximately 1600–1800 feet per minute, between two sets of closely spaced, face-to-face high-speed belts. At this time, the individual sheets are spaced at least one sheet length apart if not slightly more, where the sheets have already been folded once latitudinally. The lower set of high-speed belts subsequently terminates and is replaced by a set of low speed belts operating at approximately 1100 feet per minute. These low-speed belts are spaced a greater distance from the set of upper, high-speed belts than is the set of lower, high-speed belts. The sheets enter this region at high speed and are decelerated by a pair of freely rotating snubber wheels. The snubber wheels freely rotate about an axle which is mounted to a cam which cam is timed to rotate with the incoming sheets so that the snubber wheels positively snub the trailing region of each sheet against the set of lower, low-speed belts and underlying deck plate. The sheet is thereby effectively decelerated to the speed of the lower, low-speed belt. Moreover, the sheet is not damaged when it impacts the stop member aligned with the chopping or folding means because it has been effectively decelerated to a speed sufficiently slow for the sheet to withstand the impact with the stop member and maintain structural integrity. Additionally, the deck plate may be omitted and the sheets trapped solely against the lower, low-speed belts.

Upon impacting the stop means, or slightly before, the blade of the chopper plate strikes the centerline of the sheet in the longitudinal direction, forcing the sheet between two deck plates and into the grasp of a series of opposed, high-speed nip rollers. The chopper plate is actuated by a box cam arrangement which is timed to operate the chopper plate as the sheets instantaneously arrive at or just before the stop means. Additionally, a pair of brushes follow the snubber wheels and prevent damage to the sheet by restraining the outside edges of the sheet from wildly flailing as the chopper plate impacts the sheet and the first set of nip rollers accelerate removal of the sheet.

After being chopped in half, the sheets are removed from the chopper by a series of impinging nip rollers. These biased nip rollers both accelerate the movement of the sheet and permanently crease the fold in the sheet. After exiting the last pair of impinging rollers, the sheets travel between another set of multiple, closely spaced, face-to-face, high-speed belts. Subsequently, the lower, high-speed belt terminates and is replaced by a low-speed belt spaced farther from the upper, high-speed belt. The lower, high speed belt may be horizontally positionable so that the exit location for the sheets can be adjusted to accommodate different sizes and weights of sheets.

The folded sheets enter this region between the low and high-speed belts at a high speed and are decelerated by a pair of dual snubber wheels. These snubber wheels rotate about axles mounted to opposite ends of a cam which cam is timed to rotate with the incoming sheets so that the snubber wheels positively snub the trailing region of each sheet against the lower, low-speed set of belts, much the same as the first snubber wheel described previously. Thus, as each sheet is decelerated and the snubber wheels rotate off the sheet surface, the next subsequent sheet, traveling at a high speed, is caused to overlap the prior sheet and is decelerated by the action of the second set of dual snubber wheels. Consequently, the sheets are folded and shingled and ready to proceed into the next operation of the printing system; counting and stacking.

Figure 2A:
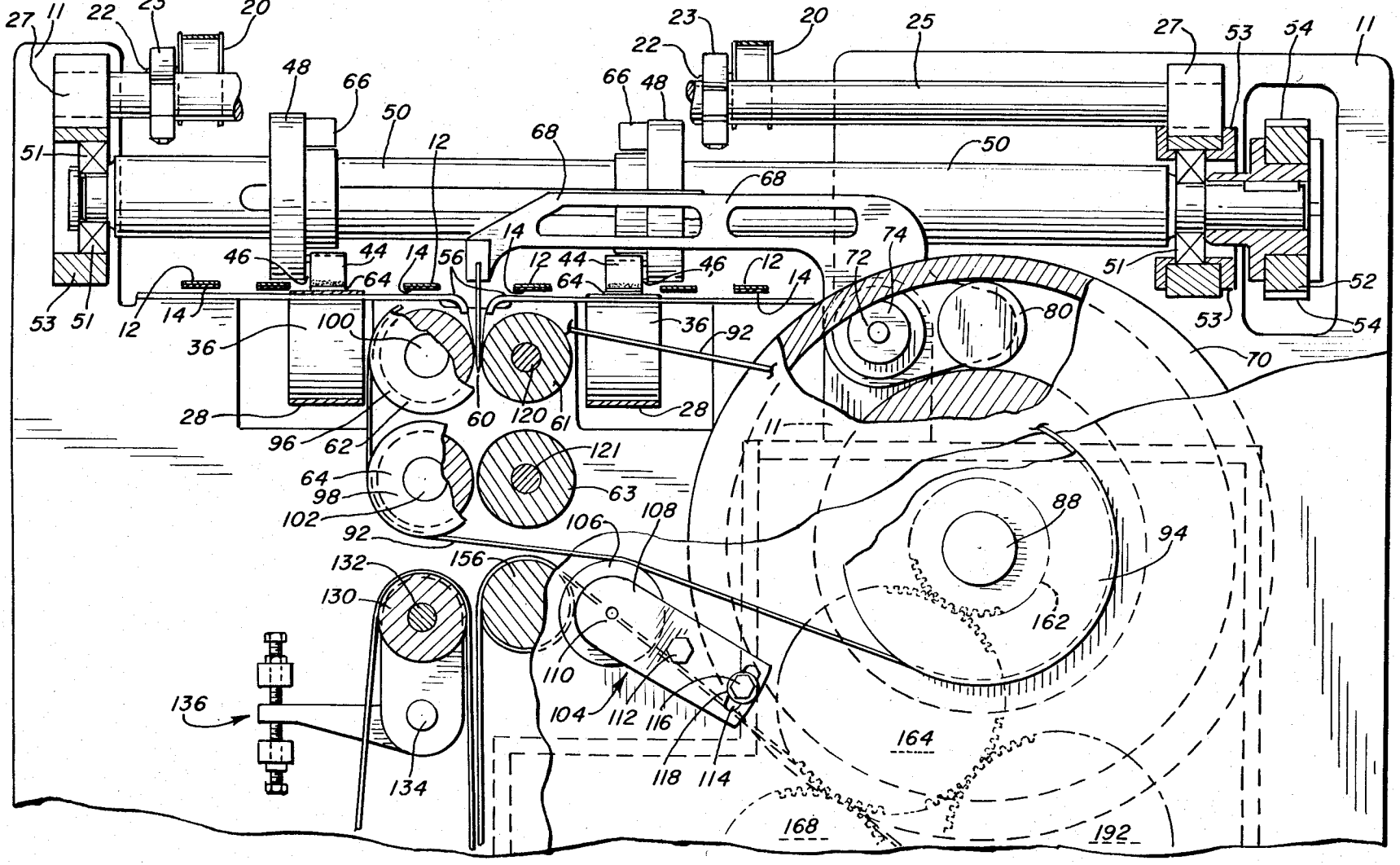
FIG. 2A is a side view of the chopping section of the preferred embodiment, a cross sectional side view of the exit conveyor system following the chopping section as well as a front view of the first snubber means.

Described in more detail, a continuous stream of sheets, each separated from the next sheet by a distance approximately equal to the length of a sheet, is delivered into the chopper-folder 10 of this invention between a series of upper, high-speed belts 12 and a series of lower, high-speed belts 14. The upper belts 12 and the lower belts 14 are disposed face-to-face and are in closely spaced relation. The upper belts 12 traverse a series of pulleys mounted on a drive shaft (not shown), a set of pulleys 16 mounted on a freely rotating shaft 18 and a second set of idler pulleys 20 also mounted on a freely rotating shaft 22. The drive shaft is driven directly from the printing press. The series of upper, high-speed belts may be adjustably tensioned by altering the position of the idler pulleys 20 by means well known in the art. As seen in FIGS. 1 and 2A, the pulleys 20 freely rotate about the axles 22 which are mounted in one end of an adjustable bracket 23. The brackets 23 are positionable about the bar 25 by commonly known means and the bar 25 is mounted in the brackets 27 affixed in the frame 11. The series of lower, high-speed belts 14 traverse the idler pulleys 24 mounted on an idler shaft 26 and a drive roller also driven by the printing press (not shown). The idler pulleys 24 mark the termination of the lower, high-speed series of belts 14.

A second lower series of belts 28, traveling at a comparatively slower speed of 1100 feet per minute, replaces the first series of lower, high-speed belts 14 just prior to entering the area where the sheet 30 will be folded. The series of lower, low-speed belts 28 is spaced a greater distance from the series of upper, high-speed belts 12 than was the series of lower, high-speed belts 14. The lower, low-speed belts 28 traverse a series of idler pulleys 32 mounted on a freely rotating shaft 34 and a set of drive pulleys 36 mounted on a drive shaft 38. A reduction gear 40, also mounted on the shaft 38, is driven by a gear 42 mounted on the shaft 18. The set of lower, low-speed belts 28 may also be driven by a variable speed, independent drive, as is well known in the art.

The sheets 30 are caused to decelerate, in order that they can be stopped without damage and folded, by means of snubber wheels 44 freely rotatable about axles 46 attached to one end of a snubber cam 48. The snubber cam 48, in turn, is mounted to a shaft 50. The shaft 50 has a timing pulley 52 mounted at one end (FIG. 2A) which is driven directly from the printing press by means of a timing belt 54. The ends of the shaft 50 freely rotate in bearings 51 mounted in the brackets 53 which are laterally slidable within the frame 11 thereby allowing the shaft 50 to be adjustably positioned along the path of the sheets 30.

As the individual sheets 30 emerge from between the upper, high-speed belts 12 and lower, high-speed belts 14, the snubbers 44 engage the rear portion of each sheet and press the sheet against the lower, low-speed belts 28 and the underlying deck plates 56. The deck plates 56 are affixed to the frame 11. Because the snubbers 44 are freely rotatable, the sheet is undamaged during the rapid deceleration. The snubber wheels 44 may be manufactured from resiliently deformable or compressible material, such as rubber, to further prevent damage to the sheets upon impact of the snubber 44. The snubbers 44 and cams 48 are timed to complete one revolution about the shaft 50 in the time one sheet is folded and the next subsequent sheet arrives to be decelerated by the snubbers 44.

Once the sheet has been decelerated and the snubbers 44 have left the sheet, the sheet is brought to a complete stop by the stop member 58 which is rigidly attached to the frame 11. Again, the sheets sustain no damage from this instantaneous stop due to the relatively slow speed at impact. A chopper plate 60 then descends, accelerates through the impact with the centerline of each sheet 30 for a distance and continues downward gradually decelerating as the sheet is driven between the two deck plates 56 and grabbed by a first pair of impinging nip rollers 61 and 62. Simultaneously, a pair of brushes 64, mounted on the shaft 50 and counterbalanced by weights 66, restrain the exterior edges of the sheets 30 from whiplashing movement as the chopper plate 60 folds the sheet 30 in half. The brushes 64 thereby prevent damage to the sheets which could occur as a result of the rapid operation of the invention.

The chopper plate 60 is affixed to one end of an arm 68 and is caused to reciprocate by the interaction of the other end of the arm 68 and the box cam 70. As seen in both FIGS. 1 and 2A, the arm 68 is rigidly attached to a shaft 72 by means of a sleeve bracket 74. The shaft 72 rotates in a cylindrical mounting bracket 76 which is affixed to the frame 11. The reciprocal movement of the arm 68, and subsequently the chopper plate 60, is caused by the action of dual cam followers 78 and 80 which rotate about a shaft 82 attached to the arm 68. The internal cam follower 78 rides on the smaller diameter cam surface 84 of the box cam 70 and the external cam follower 80 rides on the larger diameter cam surface 86 of the box cam 80. The box cam 80 rotates about the cam shaft 88.

The cam shaft 88 rotates in the bearings 89 mounted in the frame 11. The cam shaft is operatively interconnected to the drive shaft 91 (FIG. 1) of a motor (not shown) which motor drives the cam shaft 88. It is also possible, of course, to split both cam surfaces 84 and 86. Each cam surface would then, in actuality, be two cams in abutting relation. This embodiment would allow the profile of each cam surface 84 and 86 to be adjusted and modified by changing the relative position of the split cams, thereby altering the motion of the arm 68 and chopper blade 60, without installing a new cam.

The fold is completed and the crease set by the action of the high speed, impinging nip rollers 61 and 62. The left hand nip rollers 62 and 64 (FIG. 2A) rotate in the bearings 90 fixably mounted in the frame 11 (FIG. 1). A timing belt 92 driven by a timing gear 94 affixed to the cam shaft 88 drives the left hand nip rollers 62 and 64 (FIG. 2A) by means of the pulleys 96 and 98 (FIG. 3) affixed to the shaft 100 and 102 of each nip roller 62 and 64. The timing belt 92 is subject to adjustable tensioning by tensioning means 104. The tensioning means includes a pulley 106 rotatably attached to one end of a tensioning bracket 108 by a pin 110. The pulley 106 is adjustably positionable by pivotal movement of the bracket 108 about a pin 112 fixably attached to the frame 11. An arcuate slot 114 at the opposite end of the bracket 108 through which extends a threaded lug 116, fixably attached to the frame 11, limits movement of the bracket 108. A lug nut 118 receptively engages the lug 116 and locks the tensioning bracket 108 in position.

Figure 3:
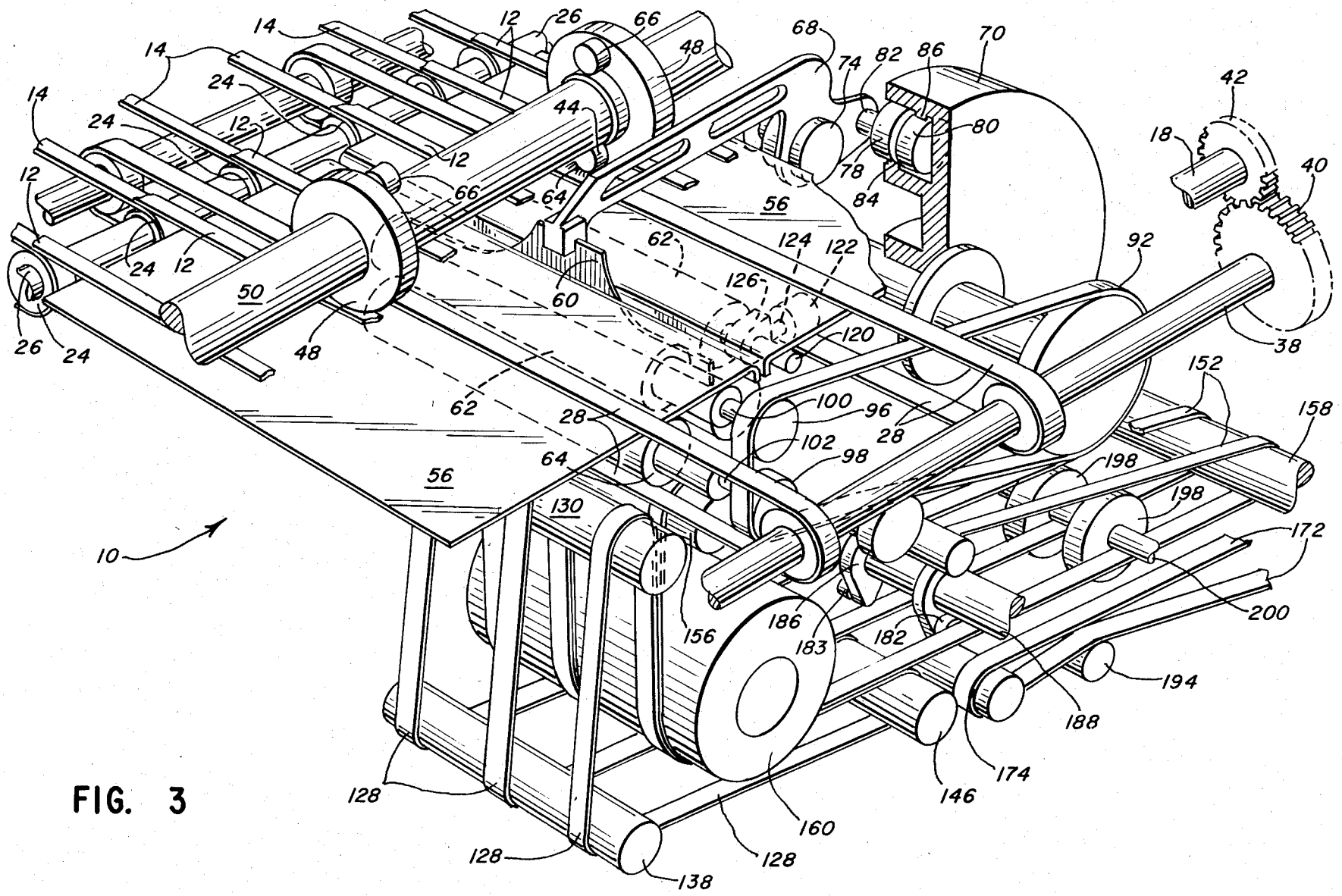
FIG. 3 is a perspective view of the preferred embodiment.

The right hand nip rollers 61 and 63 (FIG. 2A) freely rotate about the axles 120 and 121 and are biased by means of pneumatic cylinders 122, as seen in FIGS. 1 and 3, through a pair of piston arms 124 affixed to the axles 120 by brackets 126 so that these nip rollers 61 and 63 are laterally adjustable to both fold the sheets 30 and provide adaptability for thicker sheets.

In operation the chopper plate 60 drives the centerline of each sheet 30 between the deck plates 56 wherein the sheet is grabbed by the first set of high-speed nip rollers 61 and 62 which complete the fold, impart a crease in the sheet 30 and deliver the sheet 30 to the next pair of high speed nip rollers 63 and 64. This second set of nip rollers 63 and 64 then deliver the sheets 30 to a second high-speed conveyor system. The nip rollers impart a lineal speed of approximately 2,000 feet per minute to the sheets. However, the speed of the nip rollers may be varied depending on the length of the sheets used. For example, longer sheets may require a faster nip roller speed to avoid bunching of the sheets.

The second conveyor system consists of two sets of high-speed, closely spaced, face-to-face series of belts. The first set of belts 128 traverse a grouping of three sets of rollers. The first set of rollers 130 freely rotate about their common shaft 132 which shaft 132 is adjustably positionable about a pivot 134 by a commonly known adjustment means 136 incorporating two opposing set screws and locking nuts. (FIG. 2B) The position of the first set of rollers 130 is made adjustable to accommodate sheets of varying thickness. The middle set of rollers 138 rotate about a shaft 140 which is affixed to an arm 142 which is adjustable about a pivot 144 and which is also spring mounted to the frame 11 by common spring means 144 to afford constant tensioning to the first set of belts 128. The third set of rollers 146 rotate about a shaft 148 affixed to a bracket 150 which is horizontally positionable on the frame 11.

Figure 2B:
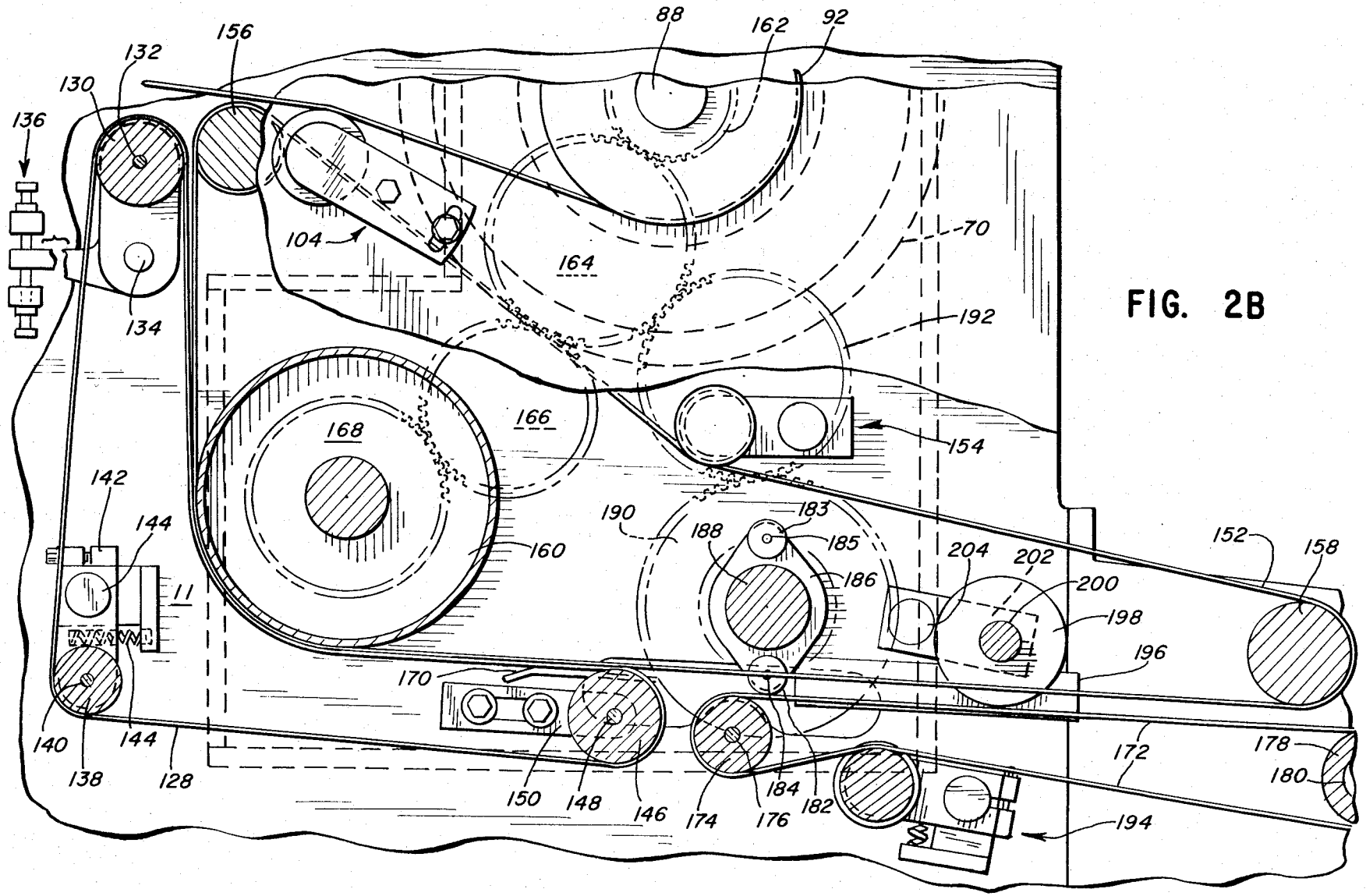
FIG. 2B is a cross-sectional side view of the remainder of the exit conveyor system and the second snubber means in the delivery section of the preferred embodiment.

The second or internal set of belts 152 (FIG. 2B) also traverse three rollers and each belt is subject to adjustable tensioning means 154 similar to that of the tensioning means 104 described in detail previously and commonly known in the art. Idler rollers 156 and 158 define the perimeter of the second or internal set of high-speed belts 152. Drive is imparted to these belts by means of the drum 160. The drum 160 receives its power from the cam shaft 88 through a gear train consisting of gears 162, 164, 166 and 168 (FIG. 2B). The first set of belts 128 are simultaneously driven by the drum 160 through the friction contact of the second set of belts 152.

The speed of the belts 128 and 152 in the second conveyor system can also be adjusted depending on the size of the sheets used. This speed may be decreased to allow the second conveyor system to sometimes function as an intermediate deceleration between the nip rollers and the delivery system.

The idler rollers 146 are laterally adjustable so that the ejection point of the sheets 30 exiting the set of high-speed, face-to-face belts 128 and 152 can be adjusted. This horizontal or lateral adjustment capability allows the invention to compensate for varying sizes and weights of sheets which will behave differently under the operation of this invention. Of course, the idler roller 146 can be permanently fixed in one position if the chopper-folder of this invention will be used with only one size and weight of paper.

A deck plate 170 underlies the lower, high-speed belts 128 and is disposed adjacent the idler roller 146. The deck plate 170, affixed to the frame 11, acts to support the sheets 30 as they are ejected from between the pairs of face-to-face, high speed belts 128 and 152. A second lower series of belts 172, traveling at a slower speed of approximately 250 feet per minute, replaces the first series of lower, high-speed belts 128 but are spaced a greater distance from the continuing upper, high-speed belts 152 than were the series of lower, high-speed belts 128. These lower, low-speed belts 172 traverse a set of idler pulleys 174 affixed to a shaft 176 and a set of drive pulleys 178 affixed to a drive shaft 180. The drive roller may be driven by direct linkage to the printing press through a gear reduction (not shown) or by a variable speed, independent drive (not shown). Both methods are well known in the art and need not be described.

The sheets 30 are caused to decelerate and to be shingled, in preparation for entering a subsequent operation, by means of dual snubber wheels 182 and 183, freely rotatable about the axles 184 and 185, attached to opposite ends of the snubber cams 186. The snubber cams 186, in turn, are mounted to a shaft 188. The cam shaft 88 imparts drive to the shaft 188 through the motion of the gear train comprising gears 162, 164, 190 and 192. Gear 162 is affixed to the cam shaft and gear 190 is affixed to the snubber shaft 188.

The use of dual snubbers is necessary in this instance rather than using a single snubber as is used to decelerate the sheets prior to their being folded. Here, the gap between the sheets has decreased due to the folding of the sheets and their subsequent acceleration by the nip rollers 61–64. However, longer contact with the individual sheets is necessary to slow the speed of the sheets to approximately 250 feet per minute. A single snubber would have to operate faster in order to trap the sheets which are now closer together and, therefore, could not maintain the longer contact with each sheet as is necessary. Consequently, a dual snubber operating at a slower speed is employed to provide longer contact with the sheets. Preferably, the snubber shaft 188 and printing press will rotate at speeds in the ratio of one-half to one.

As the individual sheets 30 exit from between the upper and lower high-speed belts 128 and 152 one set of snubbers 182 engage the rear portion of a folded sheet thereby pressing the sheet against the lower, low-speed belts 172. The snubber wheels 182 and 183 may be manufactured from resiliently deformable or compressible material, such as rubber, to further prevent damage to the sheets upon impact of the snubbers. Tensioning means 194, well known in the art and previously described in detail above in relation to the tensioning of belts 128, maintain the tension in the lower, low-speed belts 172 in order that the folded sheets may be trapped as described. A deck plate may be affixed to the frame and positioned underlying the lower, low-speed belts 172 at this point to provide additional snubbing support. As the first snubber 182 lifts off the surface of the decelerated, folded sheet, the next subsequent sheet is exiting from between the upper and lower high-speed belts 128 and 152. This next subsequent sheet is caused to overlap the previously decelerated sheet and is, itself, decelerated by the second set of snubber wheels 183. Because each set of snubber wheels 182 and 183 are freely rotatable, the sheets are undamaged during the deceleration. A pair of guide plates 196 and a series of control rollers 198 prevent misalignment of the sheets during deceleration and position the shingled sheets for entry into the subsequent counting and stacking operation.

The side guides 196 are affixed to the frame 11. The control rollers freely rotate about an axle 200. The ends of the axle 200 are mounted in the brackets 202 which brackets 202 pivot about pins 204. The pins 204 are adjustable within the frame 11 so that the position of the control wheels 198 may be laterally adjusted relative to the path of the sheets exiting the invention. This allows the control roller to be adjusted for varying sizes of sheets.

While the above description only shows one embodiment of the invention, the invention is not limited thereto since one may make modifications, and other embodiments of the principles of this invention will occur to those skilled in the art to which the invention pertains, particularly upon considering the foregoing teachings.

I claim:

1. An apparatus for folding individual sheets in a stream of spaced incoming sheets traveling at an initial lineal speed, comprising a slow-down section for decelerating each sheet, a chopping section downstream of the slow-down section for receiving the decelerated sheets from the slow-down section, successively forming a fold in the sheets, and directing the folded sheets to a delivery section; and a delivery section downstream of the chopping section for receiving folded sheets from the chopping section and delivering the sheets to a desired station; wherein a. the slow-down section comprises a first slow-speed conveyor means having a lineal speed substantially less than said initial lineal speed of the incoming sheets, a first snubber means spaced apart from the face of the first slow-speed conveyor means, the incoming sheets being received between the first snubber means and the face of the first slow-speed conveyor means, and means for driving the first snubber means in synchronism with the arrival of the sheets so as to press the tail of each incoming sheet into engagement with the first slow-speed conveyor means, which thereafter transports the sheets to the chopping section;

b. the chopping section comprises a support means for receiving and supporting a sheet arriving from the slow-speed section and including a slot oriented in a predetermined relation to the position of a sheet received and supported by the support means, a chopper plate, means for controllably reciprocating the chopper plate through the slot between a first position above the support means and a second position below the support means, thereby engaging and initiating a fold in a sheet received and supported by the support means, and nip means positioned below the slot in the support means for receiving the leading edge of the folded sheet from the chopper plate, pressing the sheet to complete the fold in the sheet, and directing the folded sheet to the delivery section; and c. the delivery section comprises a second slow-speed conveyor means having a lineal speed less than the lineal speed of the sheets supplied to the delivery section by the chopping section and a second snubber means spaced apart from a face of the second slow-speed conveyor means, the sheets from the chopping section being received between the second snubber means and the face of the second slow-speed conveyor means, and means for driving the second snubber means in phase with the arrival of the tail of the sheets so as to press the tail of each sheet onto the second slow-speed conveyor means to slow the sheet to the speed of the second slow-speed conveyor means.

2. An apparatus for folding sheets as claimed in claim 1, wherein the second snubber means of the delivery section comprises a plurality of snubbers fixed to and axially spaced along a common shaft, each snubber having two snubbing portions arranged approximately 180° apart around the common shaft, and means for rotating the shaft in synchronism with the sheets received from the chopping section by the delivery section so that the snubbers act on the sheets received by the delivery section in an alternating manner.

3. An apparatus for folding sheets as claimed in claim 2, wherein the stream of sheets supplied to the folding apparatus is provided from a printing operation having a printing cylinder and means for operating the printing cylinder at a predetermined rotational speed, and the delivery section includes means for rotating the shaft of the second snubber means at half of said predetermined rotational speed.

4. An apparatus for folding individual sheets in a stream of spaced incoming sheets traveling at an initial lineal speed, comprising a slow-down section for decelerating each sheet, a chopping section downstream of the slow-down section for receiving the decelerated sheets from the slow-down section, successively forming a fold in the sheets, and directing the folded sheets to a delivery section; and a delivery section downstream of the chopping section for receiving folded sheets from the chopping section and delivering the sheets to a desired station; wherein a. the slow-down section comprises a slow-speed conveyor means having a lineal speed substantially less than said initial lineal speed of the incoming sheets, a snubber means spaced apart from the face of the slow-speed conveyor means, the incoming sheets being received between the snubber means and the face of the slow-speed conveyor means, and means for driving the snubber means in synchronism with the arrival of the sheets so as to press the tail of each incoming sheet into engagement with the slow-speed conveyor means, which thereafter transports the sheets to the chopping section; and b. the chopping section comprises a support means for receiving and supporting a sheet arriving from the slow-speed section and including a slot oriented in a predetermined relation to the position of a sheet received and supported by the support means, a chopper plate, means for controllably reciprocating the chopper plate through the slot between a first position above the support means and a second position below the support means, thereby engaging and initiating a fold in a sheet received and supported by the support means, means disposed above the support means on both sides of the slot at least during the time the chopper plate is engaged with a sheet for restraining the sheet to sliding movement along the support means, and a nip means positioned below the slot in the support means for receiving the leading edge of the folded sheet from the chopper plate, pressing the sheet to complete the fold in the sheet, and directing the folded sheet to the delivery section wherein the restraining means comprises at least one brush fixed in relation to the snubber means so that the at least one brush is disposed above the support means in the aforesaid manner after the snubber means has pressed the tail of the sheet onto the slow-speed conveyor means.

5. An apparatus for folding individual sheets in a stream of spaced incoming sheets traveling at an initial lineal speed, comprising a slow-down section for decelerating each sheet, a chopping section downstream of the slow-down section for receiving the decelerated sheets from the slow-down section, successively forming a fold in the sheets, and directing the folded sheets to a delivery section; and a delivery section downstream of the chopping section for receiving folded sheets from the chopping section and delivering the sheets to a desired station; wherein a. the slow-down section comprises a slow-speed conveyor means having a lineal speed substantially less than said initial lineal speed of the incoming sheets, a first snubber means spaced apart from the face of the slow-speed conveyor means, the incoming sheets being received between the first snubber means and the face of the slow-speed conveyor means, and means for driving the first snubber means in synchronism with the arrival of the sheets so as to press the tail of each incoming sheet into engagement with the slow-speed conveyor means, which thereafter transports the sheets to the chopping section;

b. the chopping section comprises a support means for receiving and supporting a sheet arriving from the slow-speed section and including a slot oriented in a predetermined relation to the position of a sheet received and supported by the support means, a chopper plate, means for controllably reciprocating the chopper plate through the slot between a first position above the support means and a second position below the support means, thereby engaging and initiating a fold in a sheet received and supported by the support means, and nip means positioned below the slot in the support means for receiving the leading edge of the folded sheet from the chopper plate, pressing the sheet to complete the fold in the sheet, and directing the folded sheet to the delivery section; and c. the delivery section comprises a first conveyor means for receiving the folded sheets from the chopping section and transporting the folded sheets to a point of discharge, the first conveyor means including upper and lower closely spaced conveyor belts for transporting the folded sheets therebetween at a predetermined lineal speed and the point of discharge being defined by the termination of the downstream end of the lower conveyor belt, a second conveyor means positioned downstream of the first conveyor means for receiving folded sheets from the discharge point of the first conveyor means, the second conveyor means including a slow-speed conveyor belt having a lineal speed less than the predetermined lineal speed of the folded sheets in the first conveyor means and positioned below the point of discharge of the folded sheets from the first conveyor means, and a second snubber means spaced apart from a face of the slow-speed conveyor belt to receive folded sheets discharged from the first conveyor means, and means for timing the second snubber means with the discharge of sheets to successively press the tail of each discharged sheet into engagement with the slow-speed conveyor belt to slow each sheet to the speed of the slow-speed conveyor belt and place the sheets in shingled relation.

* * * * *